US005228492A

United States Patent [19]

Jou

[11] Patent Number: 5,228,492

[45] Date of Patent: Jul. 20, 1993

[54] ELECTRIC ROLLING STEEL DOOR SAFETY STOPPING DEVICE

[76] Inventor: Ming-Sen Jou, No. 292, Luh Guu Rd. Ding Tair Tsuen, Wuh Feng Shiang, Taichung Hsien, Taiwan

[21] Appl. No.: 726,770

[22] Filed: Jul. 8, 1991

[51] Int. Cl.[5] ..... E05F 15/00

[52] U.S. Cl. ..... 160/188; 160/1; 160/3; 160/133; 200/61.43; 318/468; 49/26

[58] Field of Search ..... 160/1, 3, 4, 7, 8, 133, 160/188, 310; 49/26, 27, 28; 200/61.43, 61.62; 318/467, 468, 266, 282

[56] References Cited

U.S. PATENT DOCUMENTS

| | | | |
|---|---|---|---|
| 2,740,856 | 4/1956 | Doeg | 200/61.43 |
| 3,210,496 | 10/1965 | Gary | 200/61.43 |
| 3,462,885 | 8/1969 | Miller | 49/27 |
| 3,728,605 | 4/1973 | Purtilo | 318/467 X |
| 3,828,698 | 8/1974 | Delanater et al. | 200/61.43 X |
| 4,115,952 | 9/1978 | French | 49/26 |
| 4,564,098 | 1/1986 | Hormann | 49/28 X |
| 4,887,205 | 12/1989 | Chou | 49/26 X |
| 4,944,116 | 7/1990 | Mewald | 49/28 X |
| 5,027,552 | 7/1991 | Miller et al. | 49/27 |

*Primary Examiner*—Blair M. Johnson
*Attorney, Agent, or Firm*—Bacon & Thomas

[57] ABSTRACT

A safety stopping device particularly adapted for use with an electric steel rolling door is disclosed which comprises a transmitter mounted on a base plate of the rolling door and a receiver mounted on and directly connected to the electric motor used for driving the rolling door. In addition, various transmit switches are mounted on the underside of the aforementioned base plate to indicate to the transmitter when an obstruction is encountered. Upon occurring an obstruction, a signal is transmitted to the receiver whereupon the flow of current to the electric motor is interrupted to cause the electric rolling steel door to automatically stop.

11 Claims, 2 Drawing Sheets

ELECTRIC ROLLING STEEL DOOR SAFETY STOPPING DEVICE

BACKGROUND OF THE INVENTION

1. Field of the Invention

The present invention pertains to the art of rolling doors and, more particularly, to the use of a safety device on an electric steel rolling door which stops or reverses the direction of the door upon sensing of an obstruction to its path of movement.

2. Description of the Prior Art

In general, rolling doors, particularly typical electric steel rolling doors, utilize two electric motor driven sprocket gears which transfer the drive from the motor to a rotating main shaft at a predetermined drive ratio. The rotational direction of the main shaft determines whether the door is rolled to a storing position or unrolled to a closed position. Guide tracks are generally mounted on both sides of the electric steel rolling door and the door itself includes guide rollers which slide within the tracks.

In order to stop the rolling or unrolling of the door, some means must be provided to disconnect the current supplied to the electric motor. In the prior art, this function is generally performed by installing a microswitch in the sliding tracks which can be contacted by a lug mounted on the electric steel rolling door. By this arrangement, the activating lug on the steel rolling door will contact the microswitch which controls the current flow to the electric motor to thereby enable the steel rolling door to stop when moving downward or upward.

Although this type of known structural safety device attains the object of automatically stopping the door, there still exists considerable need for improvement with regard to attaining a higher degree of stopping accuracy. For instance, in operation such electric steel rolling door arrangements will permit the door to hit the uppermost frame member when raised rapidly or hit the ground when lowered at a fast rate. In addition, this type of safety stopping device does not enable automatic stopping of the rolling door in accidental situations such as when an obstruction is located in the path of the rolling door.

It is also heretofore been proposed to provide for stopping the movement of the rolling door when an obstruction is encountered. Such known arrangements include devices for sensing an excessive torque increase in the output of the electric motor. In addition, complicated safety devices have been proposed which include various sensors incorporated in the roller door assembly itself. These additionally known devices are expensive to manufacture and cannot be readily adapted for use on existing rolling door units which were made without an automatic stop safety system.

Therefore, a need exists in the art for a safety stopping device for use on electric rolling steel doors and the like which is relatively easy to manufacture, effectively provides automatic stopping or reversal of the rolling door upon sensing an obstruction and which can be readily adapted to existing rolling door arrangements not incorporating such safety devices.

SUMMARY OF THE INVENTION

These and other objects of the present invention are accomplished by providing an electric rolling steel door or the like with a transmitter mounted on an upper surface of a base plate formed as part of the steel door and having a receiver, mounted on or adjacent the electric motor which drives the electric rolling steel door, which functions to receive signals emitted from the transmitter and automatically disrupts the supply of current to the motor. In addition, as least one switch is mounted on the underside of the base plate which, upon sensing of an obstruction, sends a signal to the transmitter. By this arrangement, when the switch senses an obstruction and provides a signal to the transmitter, the transmitter emits a signal to the receiver which terminates the flow of electrical current to the aforementioned electric motor so that the electric rolling steel door is automatically stopped.

By this arrangement, the switch, transmitter and receiver can be adaptably mounted upon existing rolling door assemblies and can ensure a margin of safety under potentially dangerous and emergency situations.

Other objects, features and advantages of the invention shall become apparent from the following detailed description of a preferred embodiment thereof, when taken in conjunction with the drawings wherein like reference characters refer to corresponding parts.

DETAILED DESCRIPTION OF THE PREFERRED EMBODIMENT

Figure 1:
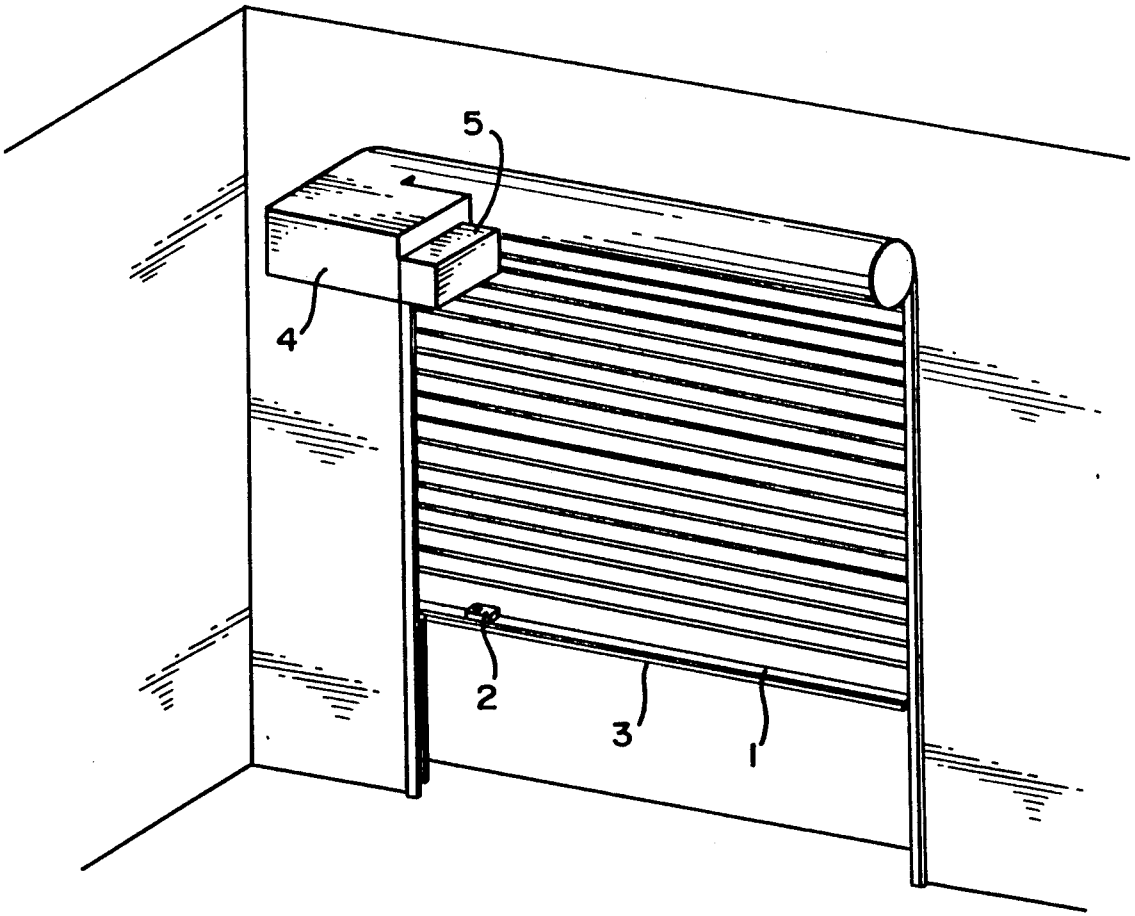
FIG. 1 is a perspective view of the main components of the safety stopping device of the present invention shown installed on a typical electric rolling steel door.

With initial reference to FIG. 1, a rolling door, preferably an electric rolling steel door, is shown including a base plate 1. Fixedly secured by any means known in the art above the upper surface of base plate 1 is a transmitter 2. In the preferred embodiment, transmitter 2 functions in a manner analogous to a television remote control utilizing an infrared signaling system. In the preferred embodiment, the rolling door is driven by an electric motor (not shown) located within a housing 4. As is known in the art, the electric motor drives a rotatable main shaft which extends across the top of the rolling door. As shown in FIG. 1, fixedly secured to motor housing 4 is a receiver 5. In the preferred embodiment, receiver 5 functions in a manner analogous to a conventional television remote control signal receiver in that it can receive signals from transmitter 2 to interrupt the supply of current. From viewing FIG. 1 it can be readily seen that receiver 5 is located substantially vertical above transmitter 2 so as to receive the signals therefrom.

Figure 2:
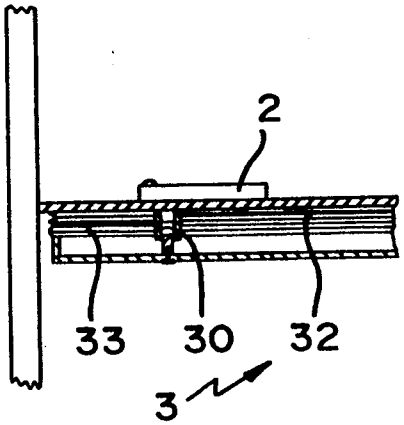
FIG. 2 is a detailed cross-sectional view of a base plate formed as part of the electric rolling steel door of FIG. 1 showing the transmitter and transmit switch.
Figure 3:
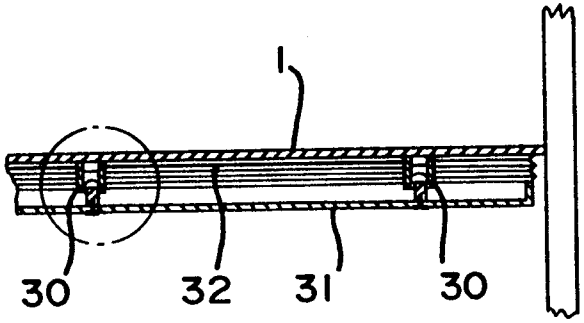
FIG. 3 is an enlarged view of the transmit switch assembly.
Figure 3:
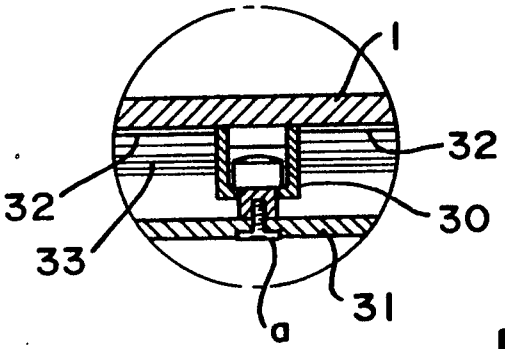

FIG. 2 is an enlarged cross-sectional view showing base plate 1 having transmitter 2 mounted on an upper surface thereof while at the same time depicting the mounting of the various transmitter switches 3 on the underside of base plate 1. With reference to both FIGS. 2 and 3, switches 3 include a number of push keys 30 which are fastened to a trough 31 by any means known in the art such as a screw generally indicated at the letter "a" in FIG. 3. In the preferred embodiment, trough 31 is made of a plastic material and is therefore lightweight. The push keys 30 of switches 3 are connected via common wires 32 to transmitter 2. Since push keys 30 are integrally secured to trough 31, a unitary structure is formed. Mounted between base plate 1 and this integral structural unit comprised of push keys 30 and trough 31 is a compressible, rubber strip 33 which serves as a lower surface medium of base plate 1.

By this arrangement, when any section of trough 31 is contacted, at least one push key 30 (3 of which are exemplary shown in FIG. 2) will be depressed. The depression of a push key 30 will result in a contact signal being generated by transmitter 2 to receiver 5 which results in the receiver 5 immediately terminating the flow of electric current to the electric motor thereby causing the electric rolling door to stop instantaneously.

By this arrangement, it can readily be seen that if trough 31 were to come into contact with an obstruction, this would be relayed through push keys 30 to transmitter 2 and receiver 5 and will result in stopping of the rolling door. By use of the transmitting system disclosed, it can readily be seen that due to its construction, the safety device of the present invention can be readily adapted for use on existing rolling doors which do not incorporate such safety devices. In addition, since transmitter 2 need not be linked with receiver 5 through wires, this adaptation is greatly enhanced. This also results in the elimination of wire fatigue and current shorting propensities of electric rolling doors controlled by direct electric wiring. It is also important to note that the safety device of the present invention can be utilized on existing rolling steel doors without requiring modifications or alterations to the basic structure of such rolling doors and that the installation procedure required to obtain automatic stopping operation in potentially dangerous or emergency situations is simply and economically performed.

It is to be understood that the form of the invention herein shown and described are to be taken as a preferred embodiment thereof and various changes in shape, material, size and arrangement of parts may be resorted to without departing from the spirit or scope of the invention as defined by the following claims.

We claim:

1. A safety stopping device for use on a rolling door including a base plate with an upper and lower surface and which is driven by current supplied to an electric motor, said safety stopping device comprising:

a switch assembly adapted to be attached to the lower surface of said base plate, said switch assembly including at least one contact switch, a trough member and a compression member, said compression member being adapted to be secured to the lower surface of said base plate, said trough member being fixedly secured to said compression member;

a transmitter adapted to be fixedly secured above the upper surface of said base plate, said transmitter being electrically connected to said at least one contact switch so as to output a control signal when the rolling door contacts an obstruction as sensed by said at least one contact switch;

receiver means adapted to interrupt the supply of current to the electric motor in response to receiving the control signal from said transmitter.

2. A safety stopping device as claimed in claim 1, wherein said transmitter outputs an electromagnetic control signal which is received by said receiver means.

3. A safety stopping device as claimed in claim 1, wherein said trough member is fixedly secured to said at least one contact switch.

4. A safety stopping device as claimed in claim 3, wherein said switch assembly includes a plurality of spaced contact switches to which said trough member is secured.

5. A safety stopping device as claimed in claim 3, wherein said trough member is formed from a plastic material.

6. A safety stopping device in combination with a rolling door including a base plate with an upper and lower surface and which is driven by current supplied to an electric motor comprising:

a switch assembly attached to the lower surface of said base plate, said switch assembly including at least one contact switch;

a transmitter fixedly secured above the upper surface of said base plate, said transmitter being electrically connected to said at least one contact switch so as to output a control signal when the rolling door contacts an obstruction as sensed by said at least one contact switch;

receiver means adapted to interrupt the supply of current to the electric motor in response to receiving the control signal from said transmitter.

7. A safety stopping device in combination with a rolling door as claimed in claim 6, wherein said transmitter outputs an electromagnetic control signal which is received by said receiver means.

8. A safety stopping device in combination with a rolling door as claimed in claim 6, wherein said switch assembly includes a trough member and a compression member, said compression member being secured to the lower surface of said base member, said trough member being fixedly secured to said compression member.

9. A safety stopping device in combination with a rolling door as claimed in claim 8, wherein said trough member is fixedly secured to said at least one contact switch.

10. A safety stopping device in combination with a rolling door as claimed in claim 9, wherein said switch assembly includes a plurality of spaced contact switches to which said trough member is secured.

11. A safety stopping device in combination with a rolling door as claimed in claim 9, wherein said trough member is formed from a plastic material.

* * * * *